US009731880B2

(12) United States Patent
Choi

(10) Patent No.: US 9,731,880 B2
(45) Date of Patent: Aug. 15, 2017

(54) CAP STRUCTURE FOR VESSEL

(71) Applicant: Jong-Suh Choi, Hwaseong-si (KR)

(72) Inventor: Jong-Suh Choi, Hwaseong-si (KR)

( * ) Notice: Subject to any disclaimer, the term of this patent is extended or adjusted under 35 U.S.C. 154(b) by 835 days.

(21) Appl. No.: 14/152,830

(22) Filed: Jan. 10, 2014

(65) Prior Publication Data

US 2015/0158640 A1 Jun. 11, 2015

(30) Foreign Application Priority Data

Dec. 6, 2013 (KR) ..... 10-2013-0151063
Dec. 27, 2013 (KR) ..... 10-2013-0165302

(51) Int. Cl.
*B65D 51/32* (2006.01)
*B65D 50/06* (2006.01)

(52) U.S. Cl.
CPC ..... *B65D 51/32* (2013.01); *B65D 50/062* (2013.01)

(58) Field of Classification Search
CPC ..... B65D 39/08; B65D 50/062; B65D 51/18; B65D 51/32; B65D 55/02; B01L 3/00; B01L 3/0241; B01L 3/0272; A45D 34/00; A45D 34/04; A45D 2200/058
USPC ..... 220/212, 254.1, 254.7–254.9, 255, 220/259.3–259.4, 259.5, 787, 800; 215/216, 220, 228; 222/546, 549–551, 222/556–557; 141/22–24, 112, 380–381; 422/934; 604/82, 89, 294
See application file for complete search history.

(56) References Cited

U.S. PATENT DOCUMENTS 4,286,633 A * 9/1981 Herr ..... B65D 50/041 141/24
4,383,618 A * 5/1983 Dougherty ..... B65D 50/046 215/216
4,633,922 A * 1/1987 Fabbro ..... B65D 41/48 141/24
4,768,682 A * 9/1988 Friedrich ..... B65D 41/06 215/222
7,874,461 B2 * 1/2011 Bae ..... B05B 11/0032 222/153.11
8,308,029 B2 * 11/2012 Ki ..... B05B 11/0027 222/153.13
2013/0074983 A1 * 3/2013 Choi ..... A45D 34/04 141/23

(Continued)

*Primary Examiner* — J. Gregory Pickett
*Assistant Examiner* — Brijesh V. Patel
(74) *Attorney, Agent, or Firm* — Novick, Kim & Lee, PLLC; Jae Youn Kim

(57) ABSTRACT

Provided is a cap structure for a vessel, which can be coupled with the vessel to open or close the vessel. The cap structure includes an inner cap coupled with an upper end portion of the vessel, an outer cap fitted around an outer-diameter surface of the inner cap, a component inserted into the outer and inner caps, at least one fixing groove extending downward from an upper end portion of the inner cap, an operating part inserted into the inner cap, a driving part formed by partially cutting an upper end portion of the operating part in a vertically downward direction, a rotational member allowing the driving part to reciprocate about the bending groove, and a detachable member to lock or release the component. The cap opens or closes the vessel by fixedly attaching the component to the cap disassembled from the vessel or separating the component from the cap.

10 Claims, 9 Drawing Sheets

(56) References Cited

U.S. PATENT DOCUMENTS

| | | | | |
|---|---|---|---|---|
| 2013/0112314 | A1* | 5/2013 | Lee | A45D 34/04 141/23 |
| 2014/0020789 | A1* | 1/2014 | Duquet | A45D 34/04 141/24 |
| 2014/0209206 | A1* | 7/2014 | Wang | G01F 11/084 141/24 |

* cited by examiner

【Fig. 1】
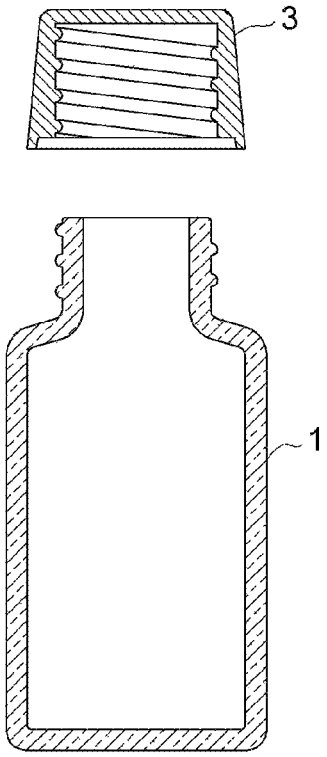
PRIOR ART

【Fig. 2】
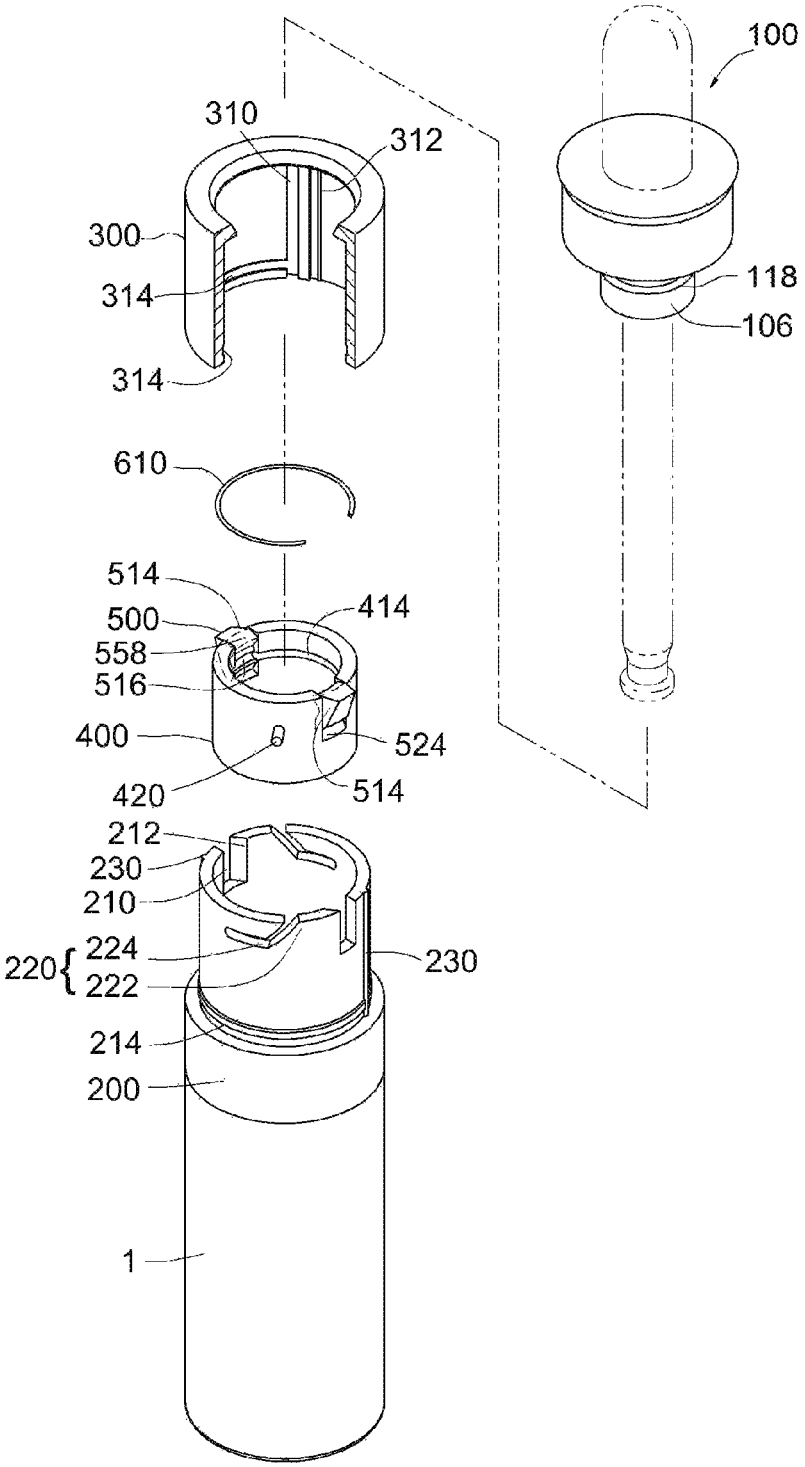

【Fig. 3】
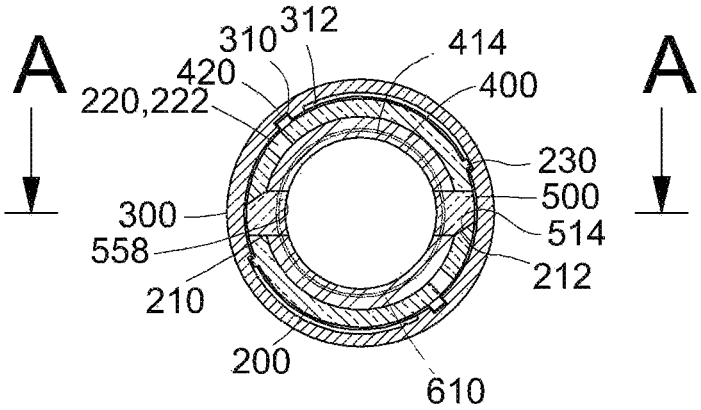
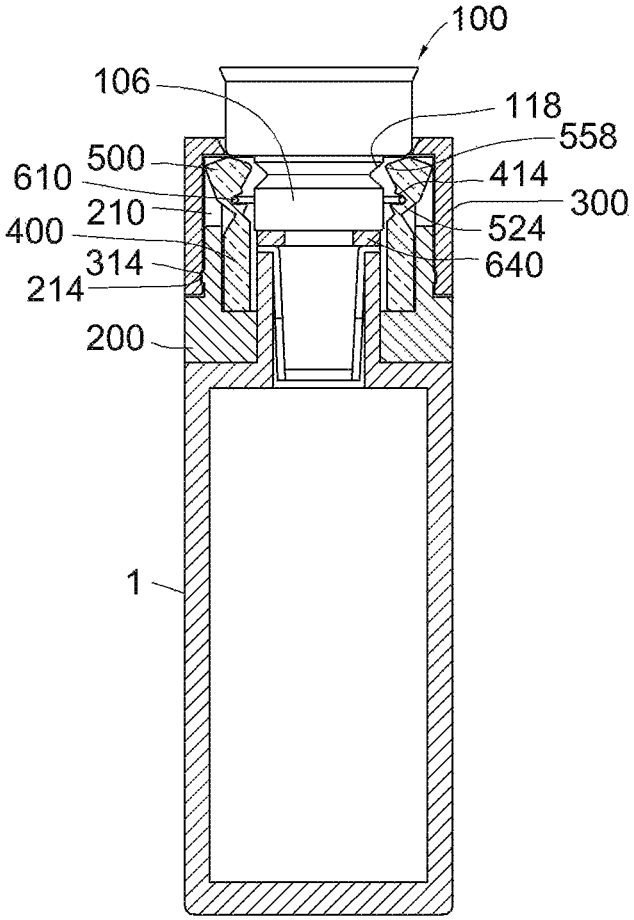

【Fig. 4】
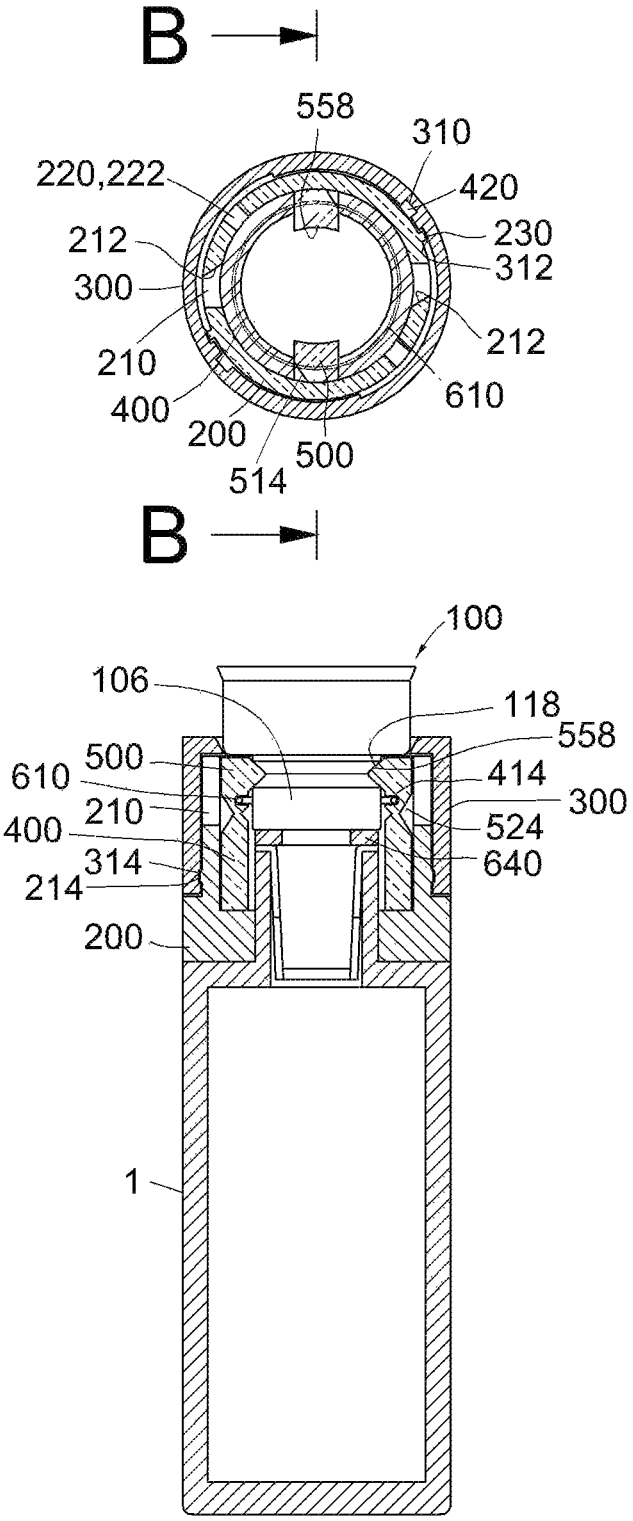

【Fig. 5】
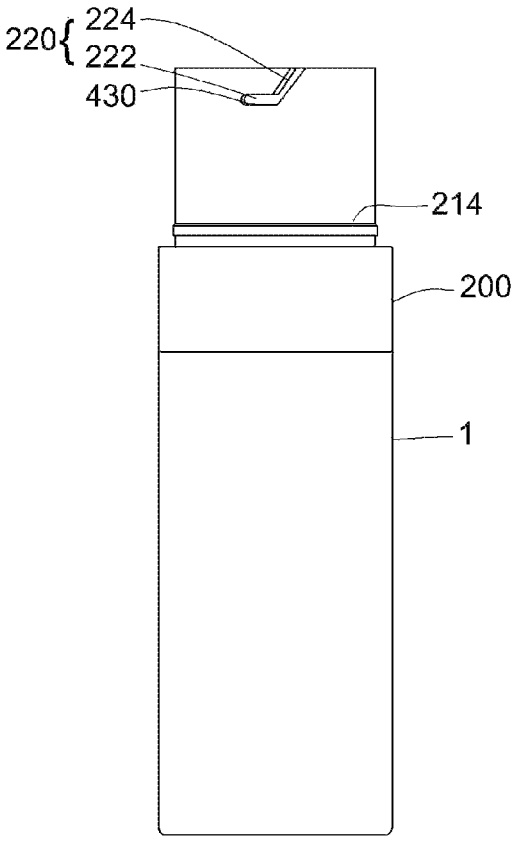

【Fig. 6】
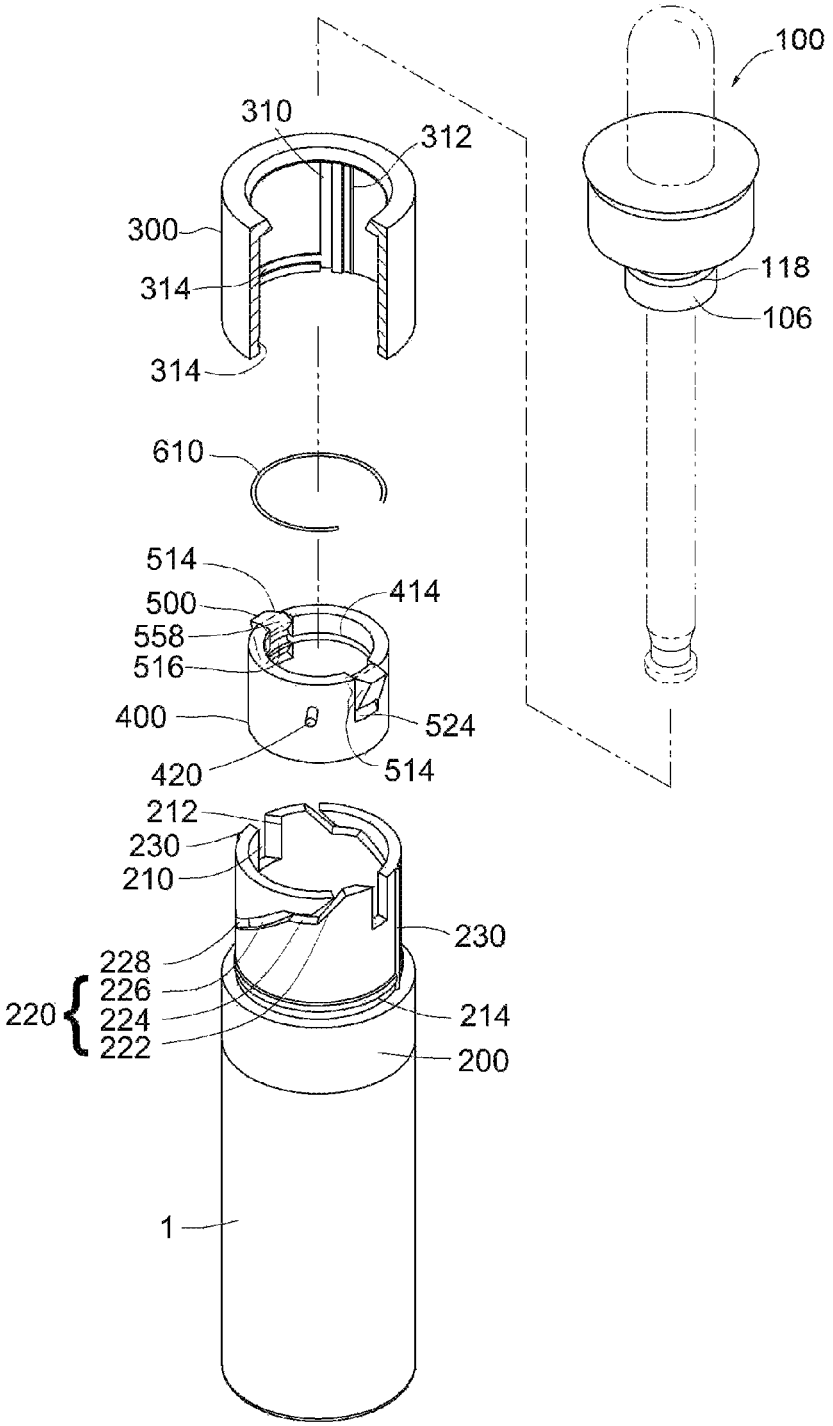

【Fig. 7】
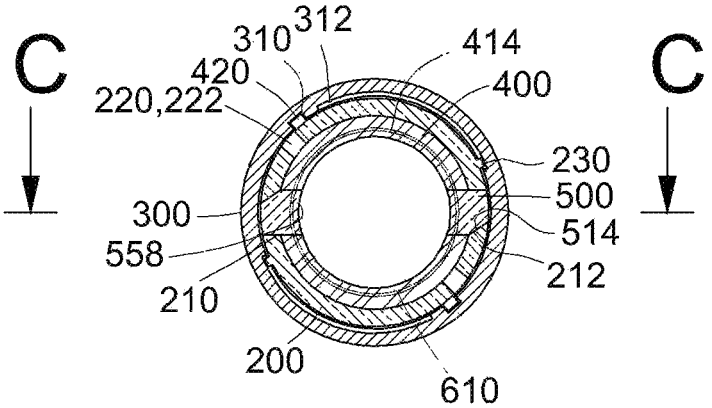
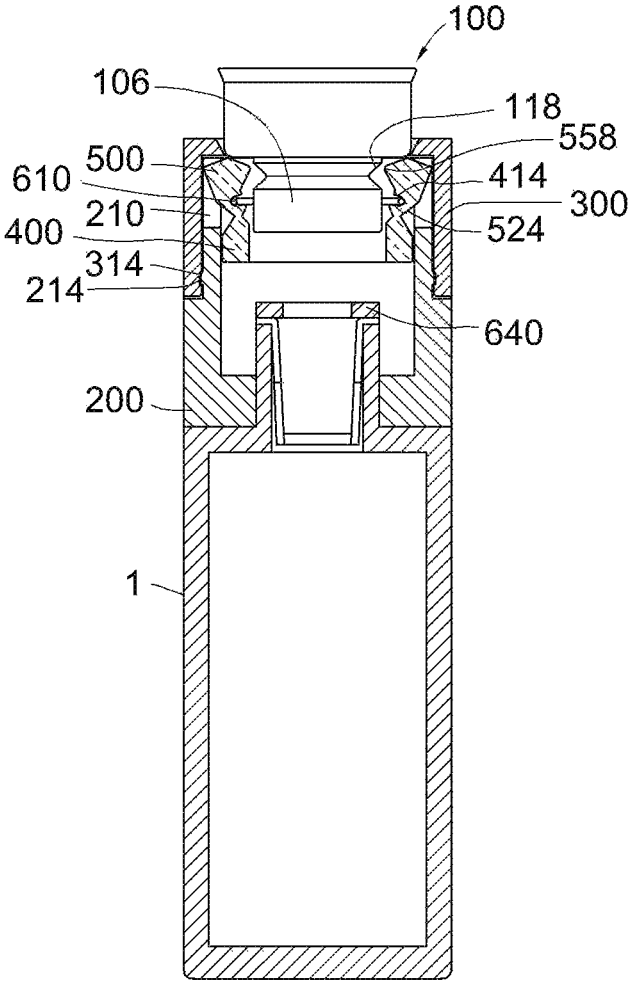

【Fig. 8】
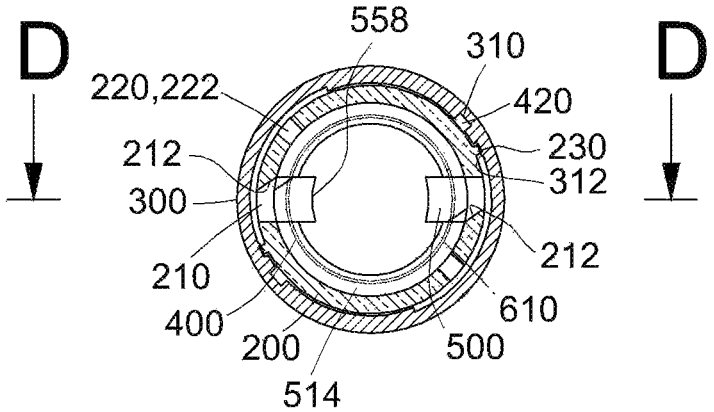
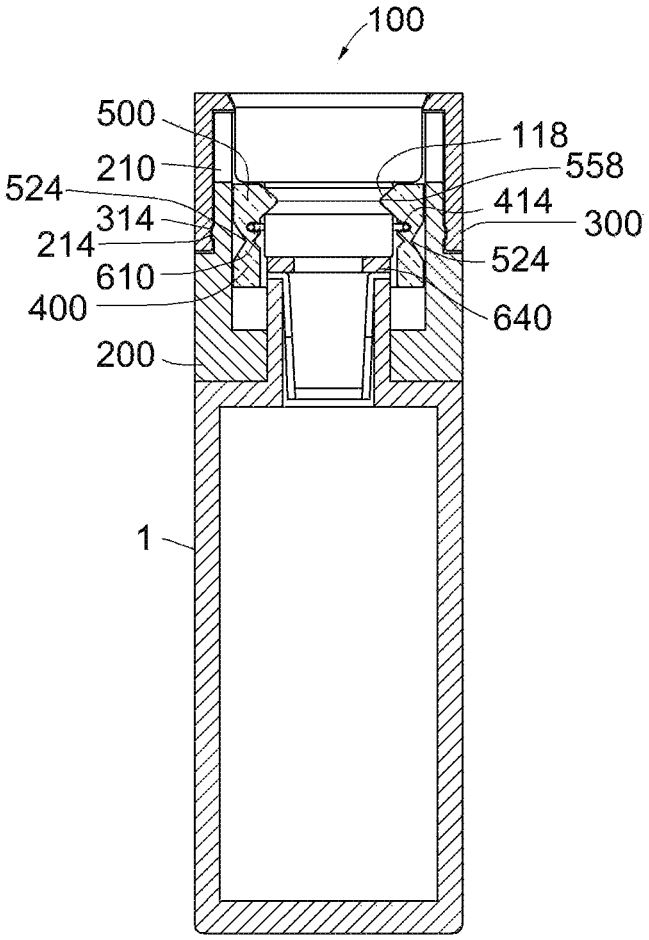

【Fig. 9】
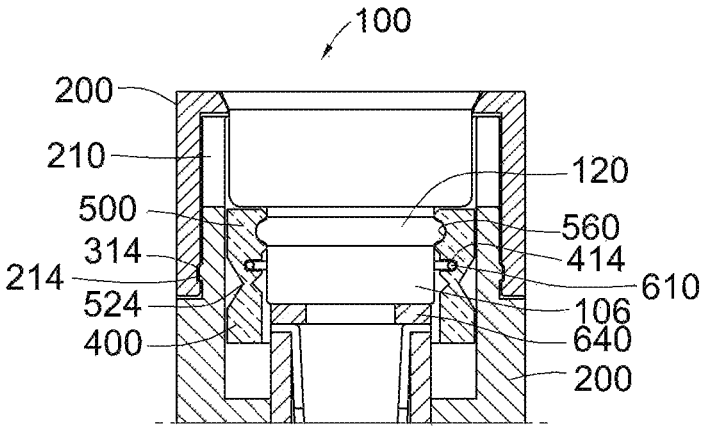
【Fig. 10】
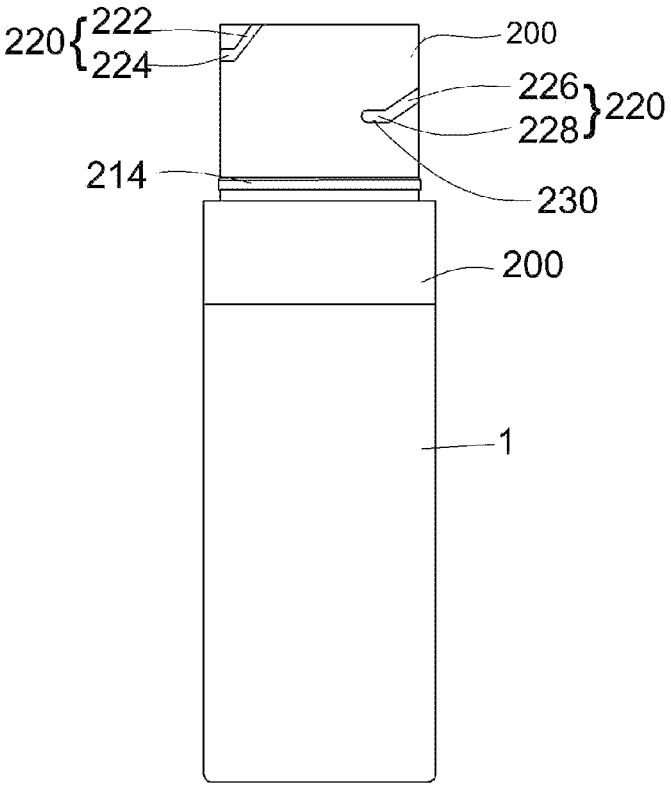

CAP STRUCTURE FOR VESSEL

BACKGROUND OF THE INVENTION

1. Field of the Invention

The present invention relates a cap structure for a vessel. In particular, the present invention relates to a cap structure for a vessel, capable of opening/closing the vessel by fixedly attaching a component to the cap, or separating the component from the cap to open the vessel in the state that the cap is not separated from the vessel.

2. Description of the Related Art

In general, to continuously open/close a cap coupled with a vessel with respect to the vessel, a screw-coupling structure is employed.

However, the conventional screw-coupling structure requires a user to inconveniently rotate the cap several times in order to open/close the cap. However, whenever the cap is open/closed, the cap must be inconveniently rotated each time.

Meanwhile, for example, when the vessel is employed for a vessel of cosmetics, as shown in FIG. 1, a cap 3 may be coupled with a vessel 1 in a screw structure, and a pipette, a mascara stick or the like may be coupled integrally with the cap 3.

In this case, when a user intends to use a cosmetic liquid contained in the vessel 1, the user must inconveniently separate the cap 2 from the vessel 1 as shown in FIG. 1 by rotating the cap 2 several times for the use of a material contained in the vessel 1.

Therefore, when a pipette, a mascara stick, or a mascara brush integrated with the cap 3 is used in the separated state from the vessel 1, the user must use the pipette, the mascara stick or the mascara brush having a low end portion spaced apart from the floor of the vessel 1 by a predetermined distance, so that the user does not use liquid remaining on the floor of the vessel 1 by using the pipette, so the user must overturn the vessel 1 and directly apply the liquid to a palm or an affected area of the user. Accordingly, high-price cosmetics may be wasted.

SUMMARY OF THE INVENTION

Accordingly, the present invention has been made keeping in mind the above problems occurring in the prior art, and the present invention provides a cap structure for a vessel, capable of opening/closing the vessel by fixedly attaching components to the cap or separating the components from the cap in the state that the cap is disassembled from the vessel.

To accomplish the object, according to one aspect of the present invention, there is provided a cap structure for a vessel, in which the cap is coupled with the vessel to open/close the vessel. The cap includes an inner cap having a cylindrical shape and coupled with an upper end portion of the vessel to open/close the vessel, an outer cap having a cylindrical shape and fitted around an outer-diameter surface of the inner cap to be coupled with the inner cap, a component inserted between the outer cap and the inner cap, at least one fixing groove extending downward from an upper end portion of the inner cap, incised with predetermined width and depth and having a fixing guiding surface which is obliquely formed or curved and gradually enlarged from an outer-diameter surface to an inner-diameter surface of one incised surface, an operating part having a cylindrical shape and inserted into the inner cap to make sliding-contact with an inner-diameter surface of the inner cap, a driving part formed by partially cutting an upper end portion of the operating part in a vertically downward direction and having a bending groove formed in at least one of outer-diameter and inner-diameter surfaces of the driving part, a rotational member allowing the driving part to reciprocate toward a center of an inner-diameter of the operating part and an outside of an outer-diameter of the operating part about the bending groove, and a detachable member to lock the component or release the locking state of the component.

In this case, the rotational member includes at least one guiding hole having an insertion hole obliquely or vertically extending downward from the upper end portion of the inner cap, and a driving hole horizontally or obliquely extending to one side from the insertion hole, at least one guiding protrusion protruding from the outer-diameter surface of the operating part at a position corresponding to a position of the guiding hole such that the guiding protrusion is inserted from an inside to an outside of the guiding hole while protruding out of the guiding hole, a driving groove extending vertically upward from a lower end portion of an inner-diameter surface of the outer cap such that the guiding protrusion protruding through the guiding hole is inserted into the driving groove, a moving guiding surface formed at one outer surface of the driving part corresponding to the fixing guiding surface of the inner cap such that the moving guiding surface makes sliding-contact with the fixing guiding surface, an elastic member having elasticity to push the driving part outward from a circumferential center, a first fitting groove formed in the inner-diameter surface of the operating part such that the elastic member is partially or entirely inserted into the first fitting groove, and a second fitting groove formed in an arc shape at an inner surface of the driving part such that a portion of the elastic member is fitted into the second fitting groove.

Preferably, the cap further includes a first stopper protruding from one side of the driving hole to prevent the guiding protrusion from being moved in a reverse direction after the guiding protrusion has been moved to the one side of the driving hole.

In addition, preferably, the cap further includes a second stopper protruding from the outer-diameter surface of the inner cap and vertically extending, and a vertical protrusion protruding from the inner-diameter surface of the outer cap while vertically extending to prevent the outer cap from being rotated in a reverse direction after the outer cap has been rotated in one direction and gone beyond the second stopper.

In addition, the rotational member includes at least one guiding hole having an insertion hole obliquely or vertically extending downward from the upper end portion of the inner cap, a driving hole horizontally or obliquely extending from the insertion hole, an up-and-down hole obliquely extending downward from an end portion of the driving hole, and a stopping hole horizontally extending from an end portion of the up-and-down hole, at least one guiding protrusion protruding from the outer-diameter surface of the operating part at a position corresponding to a position of the guiding hole such that the guiding protrusion is inserted from an inside to an outside of the guiding hole while protruding out of the guiding hole, a driving groove extending vertically upward from a lower end portion of an inner-diameter surface of the outer cap such that the guiding protrusion protruding through the guiding hole is inserted into the driving groove, a moving guiding surface formed at one outer surface of the driving part corresponding to the fixing guiding surface of the inner cap such that the moving guiding surface makes sliding-contact with the fixing guiding surface, an elastic member having elasticity to push the driving part outward from a circumferential center, a first fitting groove formed in the inner-diameter surface of the operating part such that the elastic member is partially or entirely inserted into the first fitting groove, and a second fitting groove formed in an arc shape at an inner surface of the driving part such that a portion of the elastic member is fitted into the second fitting groove.

In addition, preferably, the cap further includes a first stopper protruding from one side of the stopping hole to prevent the guiding protrusion from being moved in a reverse direction after the guiding protrusion has been moved to the one side of the stopping hole.

Preferably, the cap further includes a second stopper protruding from the outer-diameter surface of the inner cap and vertically extending, and a vertical protrusion protruding from the inner-diameter surface of the outer cap while vertically extending to prevent the outer cap from being rotated in a reverse direction after the outer cap has been rotated in one direction and gone beyond the second stopper.

Preferably, the detachable member includes at least one first detachable protrusion protruding from an inner surface of the driving part, and a first detachable groove circumferentially formed in an outer-diameter surface of the coupling part formed at a lower portion of the component.

Preferably, the detachable member includes at least one second detachable protrusion circumferentially protruding from an outer-diameter surface of the coupling part formed at the lower portion of the component, and a second detachable groove formed in an inner surface of the driving part and fitted around the second detachable protrusion.

In addition, preferably, the outer cap has a locking groove formed in a lower end portion of an inner-diameter surface of the outer cap such that the locking groove is downward fitted around at least one fixing step protruding from a lower end portion of an outer-diameter surface of the inner cap.

As described above, the present invention has following effects.

First, the component of the cap is fixedly locked or released from the locking state only by rotating the outer cap at a predetermined angle in a forward direction or a reverse direction, so that the component of the cap can be simply open/closed.

Second, the component is locked or released from the state that the component is not moved up and down, or locked or separated while being slightly moved up and down, so that the pumping tube of the pipette or the mascara stick or the mascara brush coupled with the component is closely provided to the floor of the vessel when the component is used. Accordingly, a most amount of cosmetics remaining on the floor of the vessel can be used.

Third, the component is designed to have a structure in which the component is fixedly locked or released from the locking state while the component is being moved up and down to appear. The component can be designed in the various shapes or various structures. Accordingly, the purchase need of a consumer can be increased.

BRIEF DESCRIPTION OF THE DRAWINGS

FIG. 1 is a sectional view showing the state that a component is separated from a vessel according to the related art.

FIG. 2 is an exploded perspective view showing a structure according to a first embodiment of the present invention.

FIG. 3 illustrates a cross sectional view and an A-A line longitudinal sectional view showing the state that the component is separated from the vessel according to the first embodiment of the present invention.

FIG. 4 illustrates a cross sectional view and a line B-B longitudinal sectional view showing that the component according to the first embodiment of the present invention is fixedly locked.

FIG. 5 is a front view showing the inner cap of the vessel according to the first embodiment of the present invention.

FIG. 6 is an exploded perspective view showing the structure according to the first embodiment of the present invention.

FIG. 7 illustrates a cross sectional view and a C-C line longitudinal sectional view showing the state that a component is released from the locking state to the vessel according to the second embodiment of the present invention.

FIG. 8 illustrates a cross sectional view and a D-D line longitudinal sectional view showing the state that the component according to the second embodiment of the present invention is sunken in the locking state.

FIG. 9 illustrates different examples of a detachable member according to the first and second embodiments.

FIG. 10 is a front view showing the vessel and the inner cap according to the second embodiment of the present invention.

DETAILED DESCRIPTION OF THE INVENTION

Hereinafter, the structure of a vessel 1, a component 100, an inner cap 200, and an outer cap 300, which are common component of first and second embodiments, will be described.

Although it is easy to couple the inner cap 200 having a cylindrical shape with an upper end portion of the vessel 1 according to the present invention through a screw coupling scheme, the present invention is not limited to the coupling scheme, but employs various typical coupling schemes.

As shown in FIG. 2, the outer cap 300 having a cylindrical shape is downward fitted around an outer-diameter surface of the inner cap 200. In this case, the outer cap 300 has a structure of freely rotating in the state that the outer cap 300 is coupled with the inner cap 200. Preferably, at least one fixing step 214 is circumferentially molded in the form of a protrusion on the outer-diameter surface of the inner cap 200, and a locking groove 314 is circumferentially molded in a lower end portion of an inner-diameter surface of the outer cap 300 so that the locking groove 314 is downward fitted around the fixing step 214. Accordingly, the present invention suggests a structure in which the locking groove 314 is fitted around the fixing step 314, so that the outer cap 300 can freely rotate in the state that the outer cap 300 is coupled with the inner cap 200.

First Embodiment

Hereinafter, the structure and the operation of the first embodiment will be described with reference to FIGS. 2 to 5.

As shown in FIG. 2, a fixing groove 210 is formed by downward incising an upper end portion of the inner cap 200 with predetermined width and depth, so that the inner and outer-diameter surfaces of the inner cap 200 have a perforated structure. In this case, a pair of fixing grooves 210 are preferably formed symmetrically to each other at the upper end portion of the inner cap 200.

In this case, one incised surface of the fixing groove 210 has a fixing guiding surface 212 formed in a structure chamfered in the form of a curved line or an oblique line from the outer-diameter surface toward the inner-diameter surface of the inner cap 200 so that the fixing groove 210 is gradually enlarged to the inner-diameter surface of the inner cap 200.

In addition, an operating part 400 having a cylindrical shape is fitted around the inner-diameter surface of the inner cap 200. Driving parts 500 are provided by partially cutting upper end portions of the operating part 400, which are spaced apart from each other at a predetermined distance, vertically downward by a predetermined distance. A bending groove 524 is formed in lower inner and outer-diameter surfaces of each driving part 500, so that the driving part 500 may rotate left or right toward the inner and outer-diameter surfaces of the operating part 400 about the bending groove 524 while forming an arc shape.

Preferably, a pair of driving parts 550 are formed symmetrically to each other at positions corresponding to positions of fixing grooves 210.

In addition, according to the first embodiment, a rotational member to reciprocally rotate the driving part 500 about the bending groove 524 toward the inner circumferential center of the operating part 400 and the fixing groove 210 rotates the operating part 400 at a predetermined angle while reciprocally rotating the driving part 500, and the rotational member is provided as follows.

First, as shown in FIG. 2, the inner cap 200 includes guiding holes 220 which have insertion holes 222 obliquely or vertically extending downward of the upper end portion of the inner cap 200, and driving holes 224 horizontally or obliquely extending to one side from the insertion holes 222 and are formed symmetrically to each other at the upper portion of the inner cap 200.

Further, the operating part 400 is provided on the outer-diameter surface thereof with guiding protrusions 420 molded at positions corresponding to those of the guiding holes 220 formed symmetrically to each other so that the guiding protrusions 420 protrude outward of the guiding holes 220.

A driving groove 310 is molded in the inner-diameter surface of the outer cap 300 provided outside the inner cap 200 in such a manner that an end portion of the guiding protrusion 420 protruding through the guiding hole 220 is inserted into the driving groove 310, while vertically extending from the lower end portion of the inner-diameter surface of the outer cap 300, thereby preventing the outer cap 300 from interfering with the guiding protrusion 420 inserted into the driving groove 310 when the outer cap 300 moves in a vertical direction in assembling.

In this case, as shown in FIG. 5, a first stopper 430 is preferably molded in the form of a protrusion at one side of the driving hole 224 to prevent the guiding protrusion 420 from being unintentionally moved by forcing the first stopper 430 to interfere with the guiding protrusion 420 when the guiding protrusion 420 attempts to be moved in a reverse direction after being moved to one side of the driving hole 224.

Hereinafter, another embodiment to prevent the guiding protrusion 420 from being unintentionally moved in a reverse direction after the guiding protrusion 420 has been moved to one side by a user will be described.

In other words, as shown in FIGS. 2 and 4, a second stopper 230 protrudes from the outer-diameter surface of the inner cap 200 while vertically extending.

Further, a vertical protrusion 312 is molded from the inner-diameter surface of the outer cap 300 while vertically extending corresponding to the second stopper 230.

Accordingly, when the guiding protrusion 420 or the outer cap 300 attempts to be unintentionally rotated in the reverse direction after the vertical protrusion 312 of the outer cap 300 has been rotated in one direction and then gone beyond the second stopper 230, the guiding protrusion 420 or the outer cap 300 can be prevented from being rotated in the reverse direction by the interference between the second stopper 230 and the vertical protrusion 312.

A moving guiding surface 514 is formed at one outer surface of the driving part 500 corresponding to the fixing guiding surface 212 of the inner cap 200 so that the moving guiding surface 514 makes sliding-contact with the fixing guiding surface 212 of the inner cap 200.

In addition, a first fitting groove 414 is circumferentially formed in an inner-diameter surface of the operating part 400, and an arc-shape second fitting groove 516 is circumferentially formed in an inner surface of the driving part 500, so that an elastic member 610 is fitted into the first and second fitting grooves 414 and 516, so the elasticity of the elastic member 610 is applied from the center of a circle toward the outer cap 300. Accordingly, force to push the driving part 500 outward from the center of the circle is applied to the driving part 500.

Therefore, most portions of the elastic member 610 having an open structure in the shape of "C" are inserted into the first fitting groove 414, and a less portion of the elastic member 610 is inserted into the second fitting groove 516.

Meanwhile, according to the first embodiment of the present invention, a detachable member to lock or release the component 100 inserted into the inner cap 200 has two examples.

First, as shown in FIGS. 2 to 4, at least one first detachable protrusion 558 is molded from an inner surface of the driving part 500, and a first detachable groove 118 is circumferentially formed in the outer-diameter surface of the coupling part 106 of the component 100. Therefore, as the driving part 500 moves in a central direction as shown in FIGS. 2 and 3, the first detachable protrusion 558 is inserted into the first detachable groove 118, so that the driving part 500 may be fixedly coupled with the component 100.

Second, as shown in FIG. 9, a plurality of second detachable protrusions 120 may be circumferentially molded from an outer-diameter surface of the coupling part 106 of the component 100, or one second detachable protrusion 120 may circumferentially extend.

In addition, a second detachable groove 560 is formed in the inner surface of the driving part 500, so that the second detachable protrusion 120 may be inserted into the second detachable groove 560. Therefore, as the driving part 500 moves in the central direction, the second detachable groove 560 is fitted around the second detachable protrusion 120, so that the driving part 500 may be fixedly coupled with the component 100.

Hereinafter, the operating state of the first embodiment having the above structure will be described.

When viewed in the cross sectional view of FIG. 3, as the driving part 500 is away from the center by the elasticity of the elastic member 610, the first detachable protrusion 558 of the driving part 500 is separated from the first detachable groove 118 formed in the outer-diameter surface of the coupling part 106 of the component 100. In this state, the component 100 may be separated from the vessel 1, or the component 100 may be inserted into the vessel 1 after the component 100 has been used.

Therefore, if the component 100 is inserted through the inner cap 200 in the state of FIG. 2, a lower end portion of the coupling part 106 is mounted on an upper end portion of the packing member 640 as shown in FIG. 2. In this case, the elastic member 610 elastically supports the driving part 500 in the state that the elastic member 610 is inserted into the first fitting groove 414 and the second fitting groove 516, so that the driving part 500 is away from the center. The end portion of the guiding protrusion 420 is located at a point at which the insertion hole 222 and the driving hole 224 of the guiding hole 220 meet together.

Meanwhile, regarding the operating state of fixedly locking the component 100 into the inner cap 200, as the guiding protrusion 420 inserted into the driving groove 320 is moved clockwise along the driving hole 224 as shown in FIGS. 2 and 3, the operating part 400 integrated with the guiding protrusion 420 is rotated clockwise.

Therefore, since the fixing guiding surface 212 of the fixing groove 210 is obliquely formed or curved, the driving part 500, which is rotated to the fixing groove 210 from the operating part 400 and mounted in the fixing groove 210, is rotated clockwise by the operating part 400. Accordingly, the moving guiding surface 514 of the driving part 500 making contact with the fixing guiding surface 212 is slid along the fixing guiding surface to rotate clockwise.

In this case, since the thickness of the fixing guiding surface 212 is gradually increased as shown in the cross sectional view of FIG. 3, the driving part 500 is gradually closer to the central part while rotating, so that the driving part 500 closely makes contact with the inner-diameter surface of the inner cap 200 as shown in FIG. 4.

In this case, if the guiding protrusion 420 is moved to the end portion of the driving hole 224 along the outer cap 300, the guiding protrusion 420 is stopped by the first stopper 430 molded in the form of a protrusion or by the interference between the vertical protrusion 312 of the outer cap 300 and the second stopper 230. In this case, as shown in FIGS. 2 and 3, a sixth attachable protrusion of the driving part 500 is inserted into the first detachable groove 118 of the coupling part 106 to fixedly lock the component 100.

Meanwhile, in order to separate the fixedly locked component 100, the outer cap 300 is rotated counterclockwise. In this case, the guiding protrusion 420 forcibly goes beyond the first stopper 430 to move toward the insertion hole 222, or the vertical protrusion 312 forcibly goes beyond the second stopper 230 to move counterclockwise.

The operating part 400 and the driving part 500 rotate counterclockwise as the guiding protrusion 420 rotates counterclockwise. In this case, the moving guiding surface 514 of the driving part 500 slides along the fixing guiding surface 212 while being away from the center by the elasticity of the elastic member 514 having elasticity to push the moving guiding surface 514 to the outer cap 300, so that the moving guiding surface 514 is mounted in the fixing groove 210 as shown in FIG. 3. Accordingly, the first detachable protrusion 558 of the driving part 500 is separated from the first detachable groove 118 formed in the coupling part 106 of the component 100 as shown in FIG. 3, so that the component 100 may be separated from the inner cap 200.

Second Embodiment

Hereinafter, the structure and the operation of the second embodiment will be described with reference to FIGS. 6 to 10.

The second embodiment provides a structure in which the operating part 400 and the driving part 500 of the first embodiment are moved up and down in the state that the operating part 400 and the driving part 500 are fixedly locked with the component 100, so that a portion or an entire portion of the coupling part 106 of the component 100 partially or entirely appears, which makes a difference from the first embodiment in the structure of a rotational member. Hereinafter, the second embodiment will be described while focusing on the difference in the structure of the rotational member, and the whole structures of the second embodiment will be understood based on the described of the operation thereof.

Although the guiding hole 220 according to the second embodiment is the same as that of the first embodiment in the structures of the insertion hole 222 and the driving hole 224, the second embodiment makes a difference from the first embodiment in that a up-and-down hole 226 extends downward of the end portion of the driving hole 224 in the form of an oblique line or a curved line and a stopping hole 228 horizontally extends from an end portion of the up-and-down hole 226.

Therefore, when the guiding protrusion 420 inserted into the guiding hole 220 passes through the up-and-down hole 226 via the driving hole 224, the operating part 400 and the driving part 500 are moved down.

According to the second embodiment, as shown in FIG. 10, the first stopper 430 is molded in the form of a protrusion from one side of the stopping hole 228 to prevent the guiding protrusion 420 from being moved in a reverse direction after the guiding protrusion 420 has been moved to the one side of the stopping hole 228. The second stopper 230 is molded in the form of a protrusion in the outer-diameter surface of the inner cap 200 while vertically extending as shown in FIGS. 6 and 8, and the vertical protrusion 312 is molded from the inner-diameter surface of the outer cap 300 while vertically extending, thereby preventing the outer cap 300 from being rotated in the reverse direction after the outer cap 300 has gone beyond the second stopper through the rotation in one direction similarly to the first embodiment.

Further, the operating part 400 and the inner cap 200 according to the second embodiment make a difference from the first embodiment in that the inner cap 200 is vertically lengthened or the operating part 400 is vertically shortened so that an empty space may be formed under the operating part 400 in the state that the operating part 400 is inserted into the inner cap 200 as shown in FIG. 7, thereby ensuring the space in which the operating part 400 vertically moves up and down.

In other words, since the guiding protrusion 420 of the operating part 400 is inserted into the driving groove 310 of the outer cap 300 through the guiding hole 220, when the guiding protrusion 420 moves along the up-and-down hole 226 of the guiding hole 220, the operating part 400 is moved up and down.

Meanwhile, according to the second embodiment of the present invention, a detachable member to lock or release the component 100 inserted into the inner cap 200 has two examples.

First, as shown in FIGS. 6 and 8, at least one first detachable protrusion 558 is molded from an inner surface of the driving part 500, and the first detachable groove 118 is circumferentially formed in the outer-diameter surface of the coupling part 106 formed at a lower portion of the component 100. Therefore, as the driving part 500 moves in a central direction as shown in FIGS. 2 and 3, the first detachable protrusion 558 is inserted into the first detachable groove 118, so that the driving part 500 may be fixedly coupled with the component 100.

Second, as shown in FIG. 9, a plurality of second detachable protrusions 120 may be circumferentially molded from an outer-diameter surface of the coupling part 106 formed at the lower portion of the component 100, or one second detachable protrusion 120 may circumferentially extend.

In addition, the second detachable groove 560 is formed in the inner surface of the driving part 500, so that the second detachable protrusion 120 may be inserted into the second detachable groove 560. Therefore, as the driving part 500 moves in the central direction, the second detachable groove 560 is fitted around the second detachable protrusion 120, so that the driving part 500 may be fixedly coupled with the component 100.

Hereinafter, the operating state of the second embodiment having the above structure will be described.

As shown in FIG. 7, as the driving part 500 is away from the center, the first detachable protrusion 558 of the driving part 500 is separated from the first detachable groove 118 formed in the outer-diameter surface of the coupling part 106 of the component 100. In this state, the elastic member 610 elastically supports the driving part 500 in the state that the elastic member 610 is inserted into the first fitting groove 414 and the second fitting groove 516, so that the driving part 500 is away from the center. The end portion of the guiding protrusion 420 of the operating part 400, which is fitted into the driving groove 310 of the outer according to the present invention 300, is located at a point at which the insertion hole 222 and the driving hole 224 of the guiding hole 220 meet together.

Meanwhile, in order to fixedly lock the component 100 to the inner cap 200, the outer cap 300 is rotated clockwise to move the guiding protrusion 420 fitted into the driving groove 310 clockwise along the driving hole 224, so that the operating part 400 and the driving part 500 are rotated clockwise.

Therefore, the moving guiding surface 514 of the driving part 500 mounted in the fixing groove 210 is rotated clockwise while sliding along the fixing guiding surface 212. In this case, since the fixing guiding surface 212 has a structure in which the thickness thereof is gradually increased as shown in the cross sectional view of FIG. 7, the driving part 500 is gradually closer to the central part. When the guiding protrusion 420 is moved to the end portion of the driving hole 224 along the outer cap 300, the first detachable protrusion 558 of the driving part 500 is inserted into the first detachable groove 118 of the coupling part as shown in FIG. 4 of the first embodiment, thereby fixedly locking the component 100.

Meanwhile, if the outer cap 300 is more rotated clockwise as shown in FIG. 8, the guiding protrusion 420 fitted into the driving groove 310 is moved down along the up-and-down hole 226 while rotating. In this case, the operating part 400 is moved down while rotating clockwise.

In this case, the driving part 500 inserted into the guiding groove 410 of the operating part 400 is moved down while rotating along the inner-diameter surface of the inner cap 200. Simultaneously, the first detachable groove 118 of the coupling part 106 of the component 100 fitted around the first detachable protrusion 558 of the driving part 500, the coupling part 106, and a pumping part 102 are moved down as shown in the longitudinal sectional view of FIG. 8.

Although FIG. 8 shows that the pumping part 102 is fully sunken into the outer cap 300, a portion of the pumping part 102 or the coupling part 102 may be sunken or an entire portion of the pumping part 102 may be sunken according to the intension of the inventor. Accordingly, the present invention is not limited thereto, but may have various modifications.

In this case, as described above, if the guiding protrusion 420 enters the stopping hole 228 to move after the guiding protrusion 420 has been moved to the lower end portion of the up-and-down hole 226, the guiding protrusion 420 can be prevented from forcibly going beyond the first stopper 430 formed in the stopping hole 228 and moving in the reverse direction. The second stopper 230 is molded in the form of a protrusion from the outer-diameter surface of the inner cap 200 while vertically extending as shown in FIGS. 6 and 8, and the vertical protrusion 312 is molded from the inner-diameter surface of the outer cap 300 while vertically extending corresponding to the second stopper 230, thereby preventing the outer cap 300 from rotating in a reverse direction after the outer cap 300 has been rotated in one direction and gone beyond the second stopper 230.

Meanwhile, in order to release the locking state of the component 100, which is fixedly locked in the state that the component 100 is sunken into the outer cap 300 or the inner cap 200, the outer cap 300 is rotated counterclockwise. In this case, the guiding protrusion 420 goes beyond the first stopper 430 while moving toward the up-and-down hole 226 (counterclockwise) or the vertical protrusion 312 forcibly goes beyond the second stopper 230 while moving counterclockwise.

Therefore, the guiding protrusion 420 is moved up and down along the up-and-down hole 226 while rotating counterclockwise. Since the above state is a state that the first detachable protrusion 558 and the first detachable groove 118 are engaged with each other, as the operating part 400 and the driving part 500 are moved up and down, the component 100 is moved up and down together.

In addition, if the guiding protrusion 420 reaches the driving hole 224 above the up-and-down hole 226, the component 100 is in a complete protrusion state. In this case, if the outer cap 300 is more rotated counterclockwise, the guiding protrusion 420 is moved toward the insertion hole 222 along the driving hole 224 while the driving part 500 approximates the fixing groove 210. As the moving guiding surface 514 of the driving part 500 slides along the fixing guiding surface 212 by the elasticity of the elastic member 610, the driving part 500 is mounted in the fixing groove 210.

Accordingly, if the driving part 500 is mounted in the fixing groove 210, since the first detachable protrusion 558 is separated from the first detachable groove 118 as shown in FIG. 7, a user separates the component 100 from the vessel 1 to open the vessel 1.

As described above, the present invention relates to the structure of a cap coupled with a vessel. The component attached to the cap can be easily and simply open and closed for the convenient use. In particular, as shown in FIG. 2, a pipette, a mascara stick, or a mascara brush is coupled with the component, so that an appliance coupled with the component can be simply used.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cap structure for a vessel, which is coupled with the vessel to open or close the vessel, the cap structure comprising:

an inner cap having a cylindrical shape and coupled with an upper end portion of the vessel to open or close the vessel;

an outer cap having a cylindrical shape and fitted around an outer-diameter surface of the inner cap to be coupled with the inner cap;

a component inserted into the outer and inner caps;

at least one fixing groove extending downward from an upper end portion of the inner cap, incised with predetermined width and depth and having a fixing guiding surface which is obliquely formed or curved and gradually enlarged from an outer-diameter surface to an inner-diameter surface of one incised surface;

an operating part having a cylindrical shape and inserted into the inner cap to make sliding-contact with an inner-diameter surface of the inner cap;

a driving part formed by partially cutting an upper end portion of the operating part in a vertically downward direction and having a bending groove formed in at least one of outer-diameter and inner-diameter surfaces of the driving part;

a rotational member allowing the driving part to reciprocate toward a center of an inner-diameter of the operating part and an outside of an outer-diameter of the operating part about the bending groove; and a detachable member to lock the component or release a locking state of the component.

2. The cap structure of claim 1, wherein the rotational member comprises:

a guiding hole having an insertion hole obliquely or vertically extending downward from the upper end portion of the inner cap, and a driving hole horizontally or obliquely extending to one side from the insertion hole;

a guiding protrusion protruding from an outer-diameter surface of the operating part at a position corresponding to a position of the guiding hole such that the guiding protrusion is inserted from an inside to an outside of the guiding hole while protruding out of the guiding hole;

a driving groove extending vertically upward from a lower end portion of an inner-diameter surface of the outer cap such that the guiding protrusion protruding through the guiding hole is inserted into the driving groove;

a moving guiding surface formed at one outer surface of the driving part corresponding to the fixing guiding surface of the inner cap such that the moving guiding surface makes sliding-contact with the fixing guiding surface;

an elastic member having elasticity to push the driving part outward from a circumferential center;

a first fitting groove formed in an inner-diameter surface of the operating part such that the elastic member is partially or entirely inserted into the first fitting groove; and a second fitting groove formed in an arc shape at an inner surface of the driving part such that a portion of the elastic member is fitted into the second fitting groove.

3. The cap structure of claim 2, further comprising a first stopper protruding from one side of the driving hole to prevent the guiding protrusion from being moved in a reverse direction after the guiding protrusion has been moved to the one side of the driving hole.

4. The cap structure of claim 2, further comprising:

a second stopper protruding from the outer-diameter surface of the inner cap and vertically extending; and a vertical protrusion protruding from an inner-diameter surface of the outer cap while vertically extending to prevent the outer cap from being rotated in a reverse direction after the outer cap has been rotated in one direction and gone beyond the second stopper.

5. The cap structure of claim 1, wherein the rotational member comprises:

a guiding hole having an insertion hole obliquely or vertically extending downward from the upper end portion of the inner cap, a driving hole horizontally or obliquely extending from the insertion hole, an up-and-down hole obliquely extending downward from an end portion of the driving hole, and a stopping hole horizontally extending from an end portion of the up-and-down hole;

a guiding protrusion protruding from an outer-diameter surface of the operating part at a position corresponding to a position of the guiding hole such that the guiding protrusion is inserted from an inside to an outside of the guiding hole while protruding out of the guiding hole;

a driving groove extending vertically upward from a lower end portion of an inner-diameter surface of the outer cap such that the guiding protrusion protruding through the guiding hole is inserted into the driving groove;

a moving guiding surface formed at one outer surface of the driving part corresponding to the fixing guiding surface of the inner cap such that the moving guiding surface makes sliding-contact with the fixing guiding surface;

an elastic member having elasticity to push the driving part outward from a circumferential center;

a first fitting groove formed in an inner-diameter surface of the operating part such that the elastic member is partially or entirely inserted into the first fitting groove; and a second fitting groove formed in an arc shape at an inner surface of the driving part such that a portion of the elastic member is fitted into the second fitting groove.

6. The cap structure of claim 5, further comprising a first stopper protruding from one side of the stopping hole to prevent the guiding protrusion from being moved in a reverse direction after the guiding protrusion has been moved to the one side of the stopping hole.

7. The cap structure of claim 5, further comprising:

a second stopper protruding from the outer-diameter surface of the inner cap and vertically extending; and a vertical protrusion protruding from an inner-diameter surface of the outer cap while vertically extending to prevent the outer cap from being rotated in a reverse direction after the outer cap has been rotated in one direction and gone beyond the second stopper.

8. The cap structure of claim 1, wherein the detachable member comprises:

at least one first detachable protrusion protruding from an inner surface of the driving part; and a first detachable groove circumferentially formed in an outer-diameter surface of a coupling part formed at a lower portion of the component.

9. The cap structure of claim 1, wherein the detachable member comprises:

a second detachable protrusion circumferentially protruding from an outer-diameter surface of a coupling part formed at a lower portion of the component; and a second detachable groove formed in an inner surface of the driving part and fitted around the second detachable protrusion.

10. The cap structure of claim 1, wherein the outer cap has a locking groove formed in a lower end portion of an inner-diameter surface of the outer cap such that the locking groove is downward fitted around at least one fixing step protruding from the lower end portion the outer-diameter surface of the inner cap.

* * * * *